United States Patent [19]

Wernquest

[11] Patent Number: 5,067,748

[45] Date of Patent: Nov. 26, 1991

[54] COMBINATION HOLDER/ENCLOSURE FOR MULTI-LEAF ARTICLES, ESPECIALLY NEWSPAPERS

[76] Inventor: Charles A. Wernquest, 99 Riverview Rd., Niantic, Conn. 06357

[21] Appl. No.: 610,811

[22] Filed: Nov. 8, 1990

[51] Int. Cl.[5] ..... B92D 3/00

[52] U.S. Cl. ..... 281/48; 281/29; 281/45; 402/73

[58] Field of Search ..... 281/48, 29, 45, 49, 281/34, 36, 37, 28; 402/73, 75, 76, 77

[56] References Cited

U.S. PATENT DOCUMENTS

| | | | |
|---|---|---|---|
| 3,425,421 | 2/1969 | Feder | 129/38 |
| 3,737,178 | 6/1973 | Tjernlund et al. | 281/42 |
| 4,014,508 | 3/1977 | Weiss | 248/451 |
| 4,128,262 | 12/1978 | Du Corday | 281/34 |
| 4,235,457 | 11/1980 | Brewer | 281/42 |
| 4,360,183 | 11/1982 | Biasini | 248/451 |
| 4,395,057 | 7/1983 | Young | 283/42 |
| 4,624,480 | 11/1986 | Marthaler et al. | 281/49 |
| 4,659,109 | 4/1987 | Donovan | 281/46 |
| 4,913,463 | 4/1990 | Tlapek et al. | 281/49 |
| 4,936,034 | 6/1990 | Chen et al. | 40/531 |

FOREIGN PATENT DOCUMENTS

| | | | |
|---|---|---|---|
| 1022907 | 12/1952 | France | 281/48 |

*Primary Examiner*—Timothy V. Eley
*Assistant Examiner*—Willmon Fridie, Jr.
*Attorney, Agent, or Firm*—Gerald E. Linden

[57] ABSTRACT

A combination holder/enclosure for a multi-leaf folded article is disclosed, and includes a front cover, a back cover hinged to the front cover, and means for retaining a portion of the leaves against the inside surface of the front cover and the remaining portion of the leaves against the inside surface of the back cover when the holder/enclosure is open. The front and back covers have raised edges extending from their inside surfaces, and the means for retaining the leaves is clips on the edges and bands extending from the clip on a bottom raised edge to the clip on a top raised edge of the respective cover. The hinge is an elongated member, and the means for retaining the article includes at least one band extending the length of the hinge, and holding the fold portion of the multi-leaf article against the inside surface of the hinge. When the holder/enclosure is closed, a carrying case is formed, and the multi-leaf article can be stored within the enclosure, along with other items.

9 Claims, 7 Drawing Sheets

108
108f
110
102
110a
102f
122f
102b
100
102c
124
134
108g
102e
122e
5
104c
6
102a
102d
104b
132f
104f
4
104d
118
2
122g
2
104a
4
116
104e
112
102g
132e
104
124
132g
110b
106
134
5
6
104g
114

COMBINATION HOLDER/ENCLOSURE FOR MULTI-LEAF ARTICLES, ESPECIALLY NEWSPAPERS

TECHNICAL FIELD OF THE INVENTION

The invention relates to apparatus for holding reading material, especially multi-leaf articles such as a newspaper, in an open configuration.

BACKGROUND OF THE INVENTION

Books, especially hardback cover books, are readily held open for reading simply by grasping one cover and several pages between the thumb and fingers of one hand and grasping the other cover and remaining pages between the thumb and fingers of the other hand. The relatively rigid covers provide inherent support for the pages, the pages are all bound securely within the book, and typically the individual pages of a hardback cover book measure only about two "hands" wide by three "hands" (eight inches by twelve inches). Books, even paperback books, are readily held in a variety of orientations, such as above a reclining reader's head.

Newspapers, on the other hand, tend to be larger, less rigid, and the individual pages are not bound to each other. Such multi-leaf reading materials are notoriously difficult to maintain in an open, easily readable configuration. Due to the sheer size of the individual pages, typically four hands wide by eight hands high, the pages tend to flop over without additional support. Generally, a newspaper must be held below eye level to read, supported on a table or the reader's knee, else gravity will cause the pages to flop over. The problem is further exacerbated when trying to read a newspaper out of doors, especially if there is even a breeze.

Another problem with reading newspapers is that the ink tends to adhere readily to the reader's fingers. This is a problem even when simply carrying a folded newspaper. What is needed is a convenient, lightweight device for transporting and reading a multi-leaf reading article, such as a newspaper, without the problems discussed above. Such is disclosed herein.

INFORMATION DISCLOSURE STATEMENT

Various devices have been proposed for retaining reading material in an open configuration. Among these are the following:

U.S. Pat. No. 3,737,178 discloses a book page holder having a rigid support rod 22 extending transversely across the top of a book. Two clothespin-type clamps 26 are disposed slideably along the length of the rod 22, and each clamp 26 engages the pages of a respective left or right hand half of the book.

U.S. Pat. No. 4,014,508 discloses a book holding device having a pair of rigid elongated page-retaining members 20 and 22 secured to a book-supporting board 18 by a pair of elastic cords and 28 which extend across the back of the board 18.

U.S. Pat. No. 4,360,183 discloses a retaining device for sheet music adapted to be mounted to a conventional music stand to hold sheet music to the back panel of the stand. The retaining device 28 includes a retaining arm 30 and mounting flanges 36 and 38. The flanges 36 and 38 engage a lower support flange 22 on the music stand.

U.S. Pat. No. 4,624,480 a magazine and directory cover and holder assembly having a one-piece plastic cover 12 with upturned ends 15 and 16 that form brackets for holding an elongated blade 18 in position across the spline opening of an open telephone directory 11.

Further examples of book holders and the like are found in U.S. Pat. Nos. 4,235,457 and 4,395,057. Further examples of holders or covers for magazine-type articles ar found in U.S. Pat. Nos. 4,659,109, 3,425,421 and 4,128,262. U.S. Pat. No. 4,936,034 discloses a reading stand with page turning mechanism.

U.S. Pat. No. 4,913,463 discloses a hinged case providing sectional cover with anti-pinch interleaving through, within which a substantially flat spirally bound book-like object is retained.

DISCLOSURE OF THE INVENTION

It is a therefore an object of the present invention to provide a device enabling a reader to transport and hold a newspaper, without getting dirty fingers.

It is a further object of the invention to provide a device enabling a reader to hold a newspaper in an open configuration, in a variety of orientations, even in a breeze.

According to the present invention, a combination holder/enclosure for a multi-leaf folded article comprises a rigid front cover, a rigid back cover hinged to the front cover, and means for retaining a portion of the leaves against the inside surface of the front cover and the remaining portion of the leaves against the inside surface of the back cover when the holder/enclosure is open.

According to a feature of the invention, the front and back covers have raised edges extending from their inside surfaces, and the means for retaining the leaves is clips on the edges and bands extending from a clip on a bottom raised edge to a clip on a top raised edge of the respective cover. The bands lay across the leaves, which are readily repositioned from the back to the front covers as the pages of the reading article are turned.

Further according to the invention, the hinge is an elongated member, and the means for retaining the article includes at least one band extending the length of the hinge, and holding the fold portions of the multi-leaf article against the inside surface of the hinge.

When the holder/enclosure is closed, a carrying case is formed, and the multi-leaf article can be stored within the enclosure, along with other items.

Other objects, features and advantages of the invention will become apparent in light of the following description thereof.

DETAILED DESCRIPTION OF THE INVENTION

Figure 1:
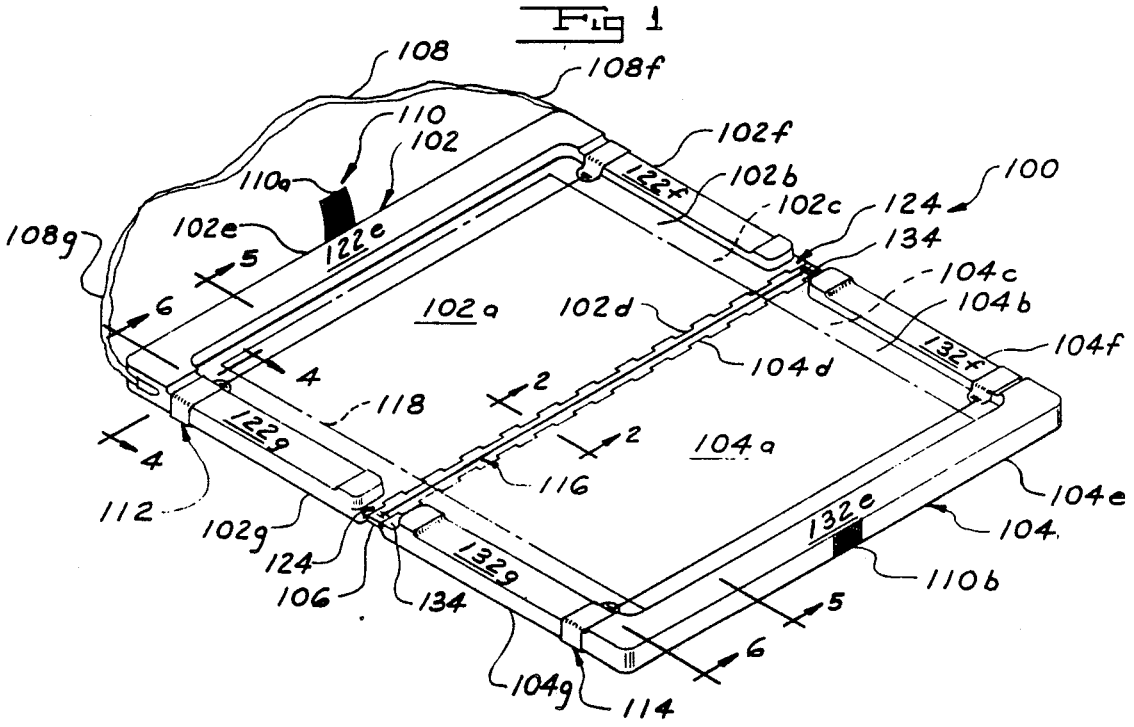
FIG. 1 is a perspective view of the combination holder/enclosure for reading material of the present invention, in an open configuration for reading a multi-leaf article.

FIG. 1 shows the combination holder/enclosure 100 of the present invention, which includes the following elements:

a front (or left) cover 102;
a back (or right) cover 104;
a spline (hinge) member 106;
a handle 108;
a closure 110;
a first page (or leaf) retaining member 112;
a second page retaining member 114; and
a third page retaining member 116.

As shown in FIG. 1, a newspaper 118 is laid open within the covers 102 and 104 and is held in place by the retaining members 112, 114 and 116.

Figure 5:
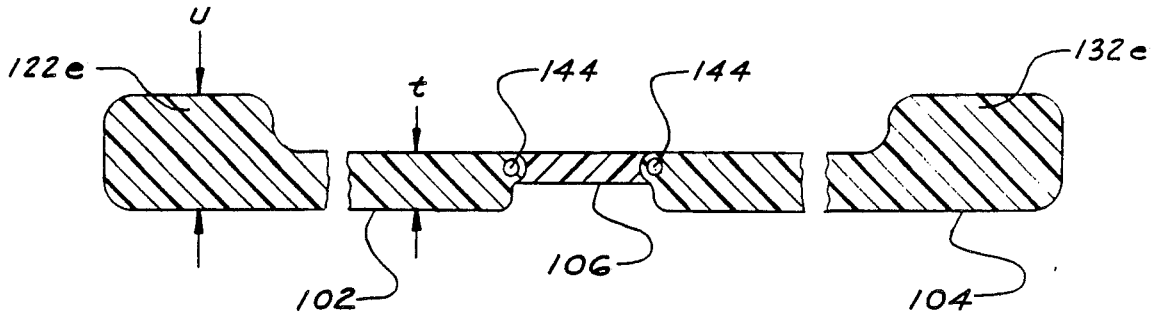
FIG. 5 is a cross-sectional view of the holder/enclosure of FIG. 1, taken on a line 5—5 therethrough.
Figure 6:
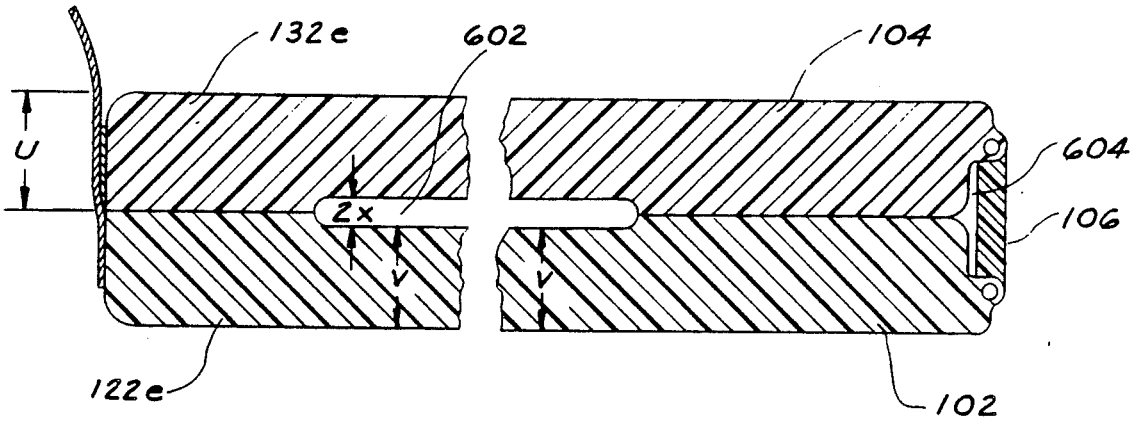
FIG. 6 is a cross-sectional view of the holder/enclosure of FIG. 1 taken on a line 6—6 therethrough, in a closed configuration for transporting a multi-leaf article.

As shown in FIGS. 5 and 6, the front cover 102 is generally rectangular, having a planar base portion 102*a*, a planar inside surface 102*b*, a planar outside surface 102*c*, an inner edge 102*d*, an outer edge 102*e* opposite the inner edge, a top edge 102*f* and a bottom edge 102*g* opposite the top edge.

The planar base portion 102*a* has a thickness, "t".

A raised edge 122 extends generally three-quarters of the way around the edge perimeter of the front cover. An outer portion 122*e* of the raised edge 122 extends along the outer edge 102*e* of the front cover, from the top edge 102*f* to the bottom edge 102*g* thereof. A top portion 122*f* of the raised edge 122 extends along the top edge 102*f* of the front cover from the outer edge portion 122*e* towards the inner edge 102*d* of the front cover 102. A bottom portion 122*g* of the raised edge 122 extends along the bottom edge 102*g* of the front cover from the outer edge portion 122*e* towards the inner edge 102*d* of the front cover 102.

The top portion 122*f* stops short of the inner edge 102*d* of the front cover 102, leaving a gap 124 extending a distance "d" from the inner edge 102*d* of the front cover 102 to the top portion 122*f*. Similarly, the bottom portion 122*g* stops short of the inner edge 102*d* of the front cover 102, leaving another gap 124 extending a distance "d" from the inner edge 102*d* of the front cover 102 to the bottom portion 122*g*.

The raised edge 122 defines an area on the inside surface 102*b* of the front cover 102 having a height "h", larger than the corresponding height dimension of a newspaper page, and having a width "w", larger than the corresponding width dimension of a newspaper page.

The outer portion 122*e* of the raised edge 122 has a thickness, "u", greater than "t". The top and bottom portions 122*f* and 122*g*, respectively, of the raised edge 122 have a thickness, "v", greater than "t" and less than "u", along most of their extent, and have a thickness "u" at their innermost extreme.

The inner edge 102*d* of the front cover 102 is provided with square cutouts 126, and with a hole 128 extending from the bottom edge 102*g* to the top edge 102*f* through the cutouts 126, for forming a hinge with the spline member 106, as described hereinafter.

The front cover 102 is preferably formed of rigid stock material, such as plastic.

As shown in FIGS. 1, 5 and 6, the back cover 104 is basically a "mirror image" of the front cover 102. The back cover 104 is generally rectangular, having a planar base portion 104*a*, a planar inside surface 104*b*, a planar outside surface 104*c*, an inner edge 104*d*, an outer edge 104*e* opposite the inner edge, a top edge 104*f* and a bottom edge 104*g* opposite the top edge.

The planar base portion 104*a* has a thickness, "t".

A raised edge 132 extends generally three-quarters of the way around the edge perimeter of the back cover. An outer portion 132*e* of the raised edge 132 extends along the outer edge 104*e* of the back cover, from the top edge 104*f* to the bottom edge 104*g* thereof. A top portion 132*f* of the raised edge 132 extends along the top edge 104*f* of the back cover from the outer edge portion 132*e* towards the inner edge 104*d* of the back cover 104. A bottom portion 132*g* of the raised edge 132 extends along the bottom edge 104*g* of the back cover from the outer edge portion 132*e* towards the inner edge 104*d* of the back cover 104.

The top portion 132*f* stops short of the inner edge 104*d* of the back cover 104, leaving a gap 134 extending a distance "d" from the inner edge 104*d* of the back cover 104 to the top portion 132*f*. Similarly, the bottom portion 132*g* stops short of the inner edge 104*d* of the back cover 104, leaving another gap 134 extending a distance "d" from the inner edge 104*d* of the back cover 104 to the bottom portion 132*g*.

The raised edge 132 defines an area on the inside surface 104*b* of the back cover 104 having a height "h" , larger than the corresponding height dimension of a newspaper page, and having a width "w", larger than the corresponding width dimension of a newspaper page.

The outer portion 132*e* of the raised edge 132 has a thickness, "u", greater than "t". The top and bottom portions 132*f* and 132*g*, respectively, of the raised edge 132 have a thickness, "v", greater than "t" and less than "u", along most of their extent, and have a thickness "u" at their innermost extreme.

The inner edge 104*d* of the back cover 104 is provided with square cutouts 136, and with a hole 138 extending from the bottom edge 104*g* to the top edge 104*f* through the square cutouts 136, for forming a hinge with the spline member 106, as described hereinafter.

The back cover 104 is preferably formed of rigid stock material, such as plastic.

As shown in FIGS. 1, 2, 3A, 5 and 6, the spline member 106 is essentially a rigid, elongated member 106*a*, and forms a hinge with the inner edges of the front and back covers. The spline member 106 has a inside surface 106*b* contiguous with the inside surfaces of the front and back covers, an outside surface 106*c*, a "front" edge 106*d*, a "back" edge 106*e* opposite the front edge, a top edge 106*f*, and a bottom edge 106*g*.

The front edge 106*d* is contiguous with the inner edge 102*d* of the front cover 102, and is provided with a series of square cutouts 140 alternating with the square cutouts 126. A hole 142 extends from the bottom edge 106*g* to the top edge 106*f*, through the square cutouts 140 and is in-line with the hole 128 along the inner edge 102*d* of the front cover 102. A pin 144 extends through the holes 128 and 142.

The back edge 106*e* is contiguous with the inner edge 104*d* of the back cover 104, and is provided with a series of square cutouts 140 alternating with the square cutouts 136. A hole 142 extends from the bottom edge 106*g* to the top edge 106*f*, through the square 104*d* of the back cover 104. A pin 144 extends through the holes 138 and 142.

Alternatively, in lieu of the square cutouts 126, 136 and 140, the holes 128, 138 and 142, and the pins 144, the spline member could be formed integrally with the front and back covers to form a "living" hinge.

The spline member 106 is preferably formed of rigid stock material, such as plastic.

A handle 108 extends from the outer edge of one or the other of the front or back covers. As shown in FIG. 1, the handle is in the form of a strap, secured at one end 108*g* to the bottom edge 102*g* of the front cover and at the other end 108*f* to the top edge 102*f*. The strap 108 is preferably sufficiently long to function as a shoulder strap for carrying the (folded) holder/enclosure 100, and is made of a suitably flexible material such as nylon web.

Figure 7:
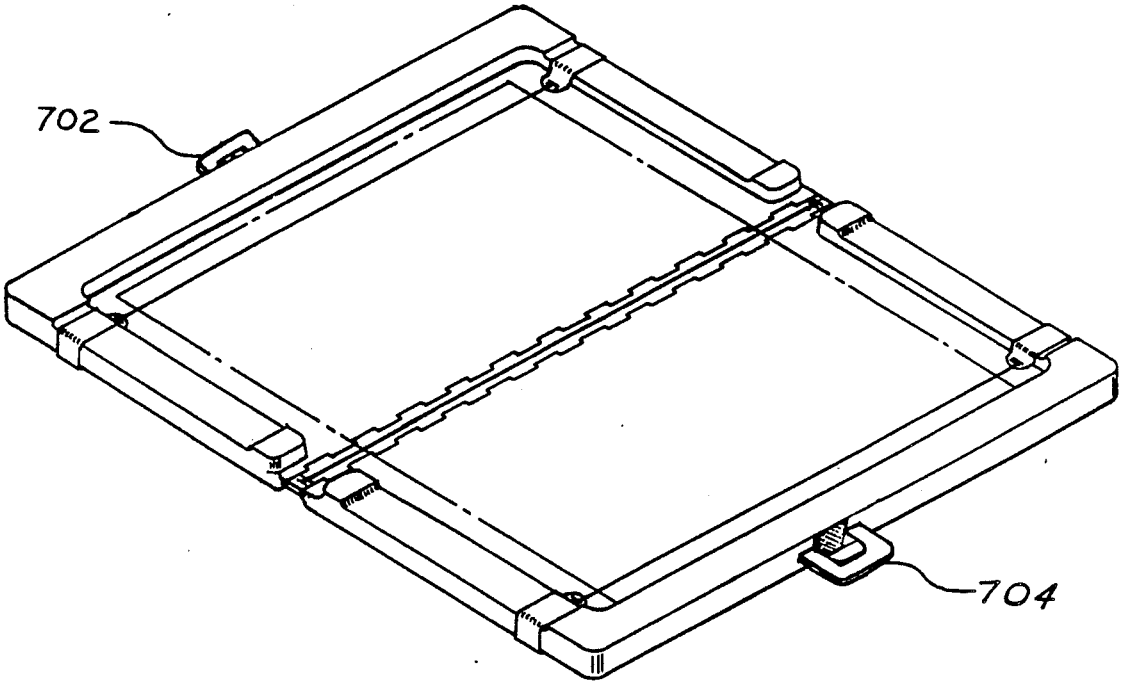
FIG. 7 is a perspective view of an alternate embodiment of the holder/enclosure of FIG. 1.

As shown in FIG. 7, alternatively, smaller, handles 702 and 704, generally the size and shape of common briefcase handles, could be provided extending from the midpoints of the outer edges of both the front and back covers. This provides convenient handsize "openings" for holding the holder/enclosure in an open configuration.

Figure 4:
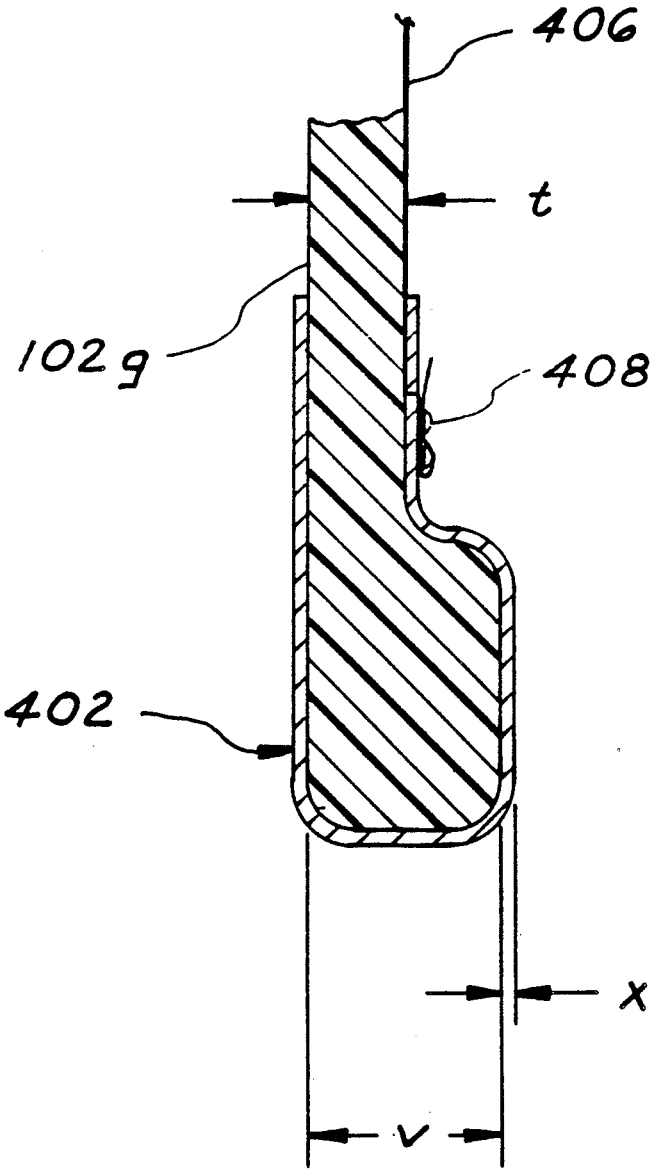
FIG. 4 is a cross-sectional view of the holder/enclosure of FIG. 1, taken on a line 4—4 therethrough.

As shown in FIGS. 1 and 4, the first page (leaf) retaining member 112 includes a first metal bracket 402 slideably positionable along the bottom raised edge portion 122*g* of the left cover 102, a second metal bracket 404 slideably positionable along the top raised edge portion 122*f* of the left cover 102, and a band 406 extending across the flat inner surface 102*b* of the left cover 102 from the first bracket 402 to the second bracket 404.

Similarly, the second page (leaf) retaining member 114 includes a first metal bracket 402 slideably positionable along the bottom raised edge portion 132*g* of the right cover 104, a second metal bracket 404 slideably positionable along the top raised edge portion 132*f* of the right cover 104, and a band 406 extending across the flat inner surface 104*b* of the right cover 104 from the first bracket 402 to the second bracket 404.

The bands 406 are resilient, formed of elastic or the like, and lay reasonable flat against the respective inner surfaces 102*b* and 104*b*. The bands are suitable tensioned to allow them to be pulled away from the inner surface (102*b*, 104*b*) so that individual leaves of the newspaper 118 can be inserted between the band and the inner surface, and retained in place thereby.

In order to facilitate operation of the first and second leaf retaining members 112 and 114, and in order to accommodate a wide range of sizes of reading material, the brackets 402 and 404 are slideable over the extent of the bottom and top raised edges (e.g., 102*g*, 102*f*).

To this end, it is seen that the bottom and top raised edges are "scalloped", having a thickness "v" slightly less than the thickness "u" of the remaining raised edges. The difference in thickness is approximately equal to or slightly greater than the thickness "x" of the stock material (sheet metal) from which the brackets are formed. Further, it is seen that the inner and outer ends of the bottom and top raised edge portions are of thickness "u" (See FIGS. 5 and 6), to limit the lateral adjustment range of the metal brackets.

With reference to FIG. 4, it is seen that a typical metal bracket 402 is formed from a single piece of sheet metal folded into a generally "U-shaped" configuration. The outer, or bight portion of the bracket 402 is shaped to fit around the sliding area of the raised edge portion (e.g., 102*g*), having a thickness "v". The inner, or leg portions of the bracket 402 is shaped to fit around the base portion (102*a*) of the cover (102). The band 406 is preferably disposed to attach to an inside surface of the metal bracket 402 so that the band is flush against the base portion 102*a*, and is adjustably attached to the inner leg of the metal bracket 402 by any suitable means such as by looping between two slots 408.

The following relationship is evident:

The thickness "u" of the outer raised edges 102*e* and 104*e* is equal to or slightly greater than the thickness "v" of the sliding areas 122*f*, 122*g*, 132*f* and 132*g* plus the thickness "x" of the metal brackets 402, 404 (e.g., $u=v+x$).

In use, the holder 100 is laid open, and a portion of the leaves (pages) of a newspaper are tucked under the band 406 on the left cover 102. The remaining portion of the leaves are tucked under the band 406 on the right cover 104. The reader then grasps the outer edge 102*e* of the front cover in his left hand, and grasps the outer edge 104*e* of the back cover 104 in his right hand. (Alternatively, the reader inserts his hands into the handles 702, 704 of FIG. 7.) As the reader progresses from page-to-page, individual leaves from the back (right) cover 104 are removed from under the band 406 of the back (right) cover and are repositioned under the band 406 of the left cover.

Evidently, the raised edge portions 122*e*, 122*f* and 122*g* about the perimeter of the left cover 102 and the raised edge portions 132*e*, 132*f* and 132*g* around the perimeter of the right cover 104 form cavity in which the newspaper resides, and also form a windbreak to alleviate the effects of a breeze when reading the newspaper out of doors.

A third page retaining member 116 may also be provided. As shown in FIG. 1, the third page-retaining member may be a single band 200 extending from the bottom edge 106*g* of the hinge 106 to the top edge 106*f* thereof. The band 200 lays across the fold of the reading article. The band 200 can be an elastic band, or a more rigid rod. The third page retaining member 116 is highly beneficial in retaining the newspaper in a breeze.

Figure 2:
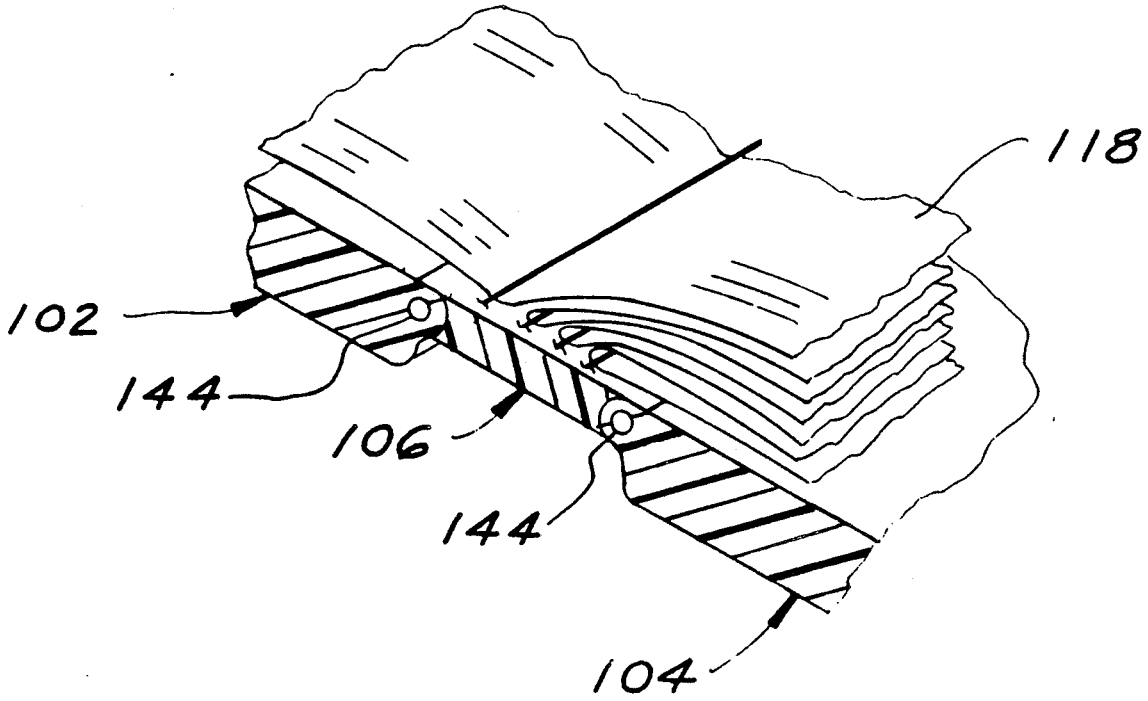
FIG. 2 is a perspective view of a hinge detail of the holder/enclosure of FIG. 1.
Figure 3A:
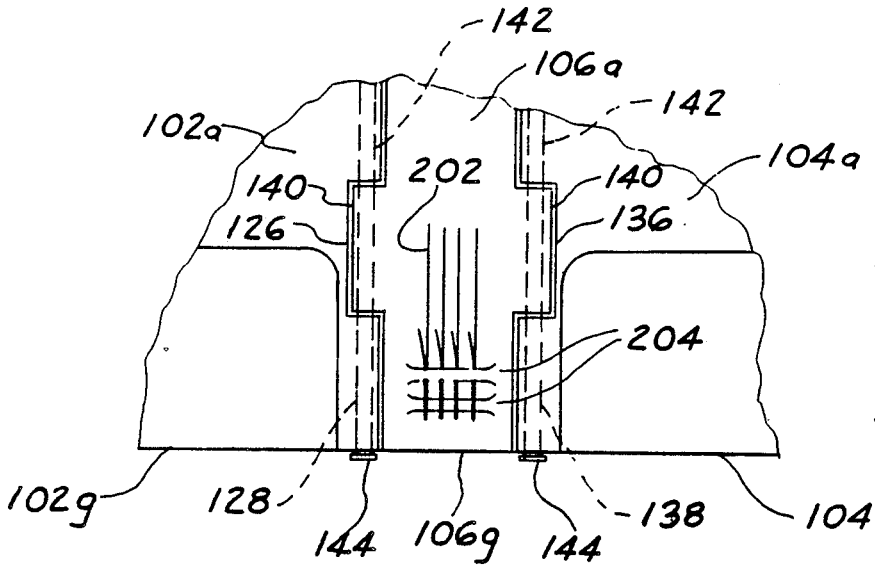
FIG. 3A is a plan view of a hinge detail of the holder/enclosure of FIG. 1.
Figure 3B:
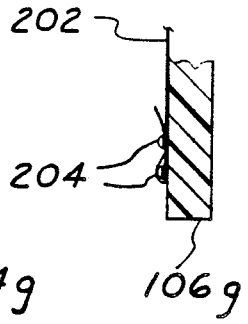
FIG. 3B is a cross-sectional view of the hinge detail of FIG. 3A.

As shown in FIGS. 2, 3A and 3B, the third page retaining member 116 may include multiple bands 202 retaining multiple folds of the reading article against the inside surface 106*a* of the hinge member 106. Four bands 202 are shown. Each band is capable of holding the fold of an individual newspaper section.

As shown in FIGS. 3A and 3B, the bands 202 are elastic, and their (top and bottom) ends are retained in pairs of slots 204 formed in the top and bottom ends of the hinge member. In this manner, the length of each band is adjustable.

As shown in FIGS. 1 and 6, a closure 110 is provided for securing the front and back covers together when the combination holder/enclosure 100 is folded for transporting a multi-leaf article therein. As shown in FIG. 1, the closure comprises a part 110*a* on the outer edge 102*e* of the front cover 102 and a part 110*b* on the outer edge 104*e* of the back cover 104. These parts 110*a* and 110*b* will interlock when the holder/enclosure is folded (closed), as shown in FIG. 6.

When the holder/enclosure is closed, the outer portions 122*e* and 132*e* of the raised edges contact each other, and a small gap is left between the respective sliding areas of the top and bottom portions of the raised edges of the front and back covers. In this manner, a carrying case is formed, and the newspaper can be carried within the cavity formed by the front and back covers. Additionally, other articles, such as reading glasses, pens, beach articles, suntan lotion, etc., can be carried along with the newspaper.

Returning to FIG. 6, it is evident that a gap 602 remains between the scalloped portions of the top raised edges 122*f* and 132*f* of the left and right portions 102 and 104, respectively, when the holder is closed. (Brackets 402 are ommitted in this view.) However, the gap 602 is very small, measuring approximately only twice the thickness "x" of a bracket 402. A similarly tiny gap 604 is left in the hinge area when the holder is closed. These gaps 602 and 604 are sufficiently small to prevent articles carried within the holder/enclosure from falling out when the holder/enclosure is closed.

What is claimed is:

1. Combination holder/enclosure for a multi-leaf folded article comprising:

a rigid, generally planar, generally rectangular front cover having a planar inside surface, an inner edge, an outer edge opposite the inner edge, a top edge, a bottom edge opposite the top edge, an inside surface and an outside surface;

a rigid, generally planar, generally rectangular back cover having a planar inside surface, an inner edge, an outer edge opposite the inner edge, a top edge, a bottom edge opposite the top edge, an inside surface and an outside surface;

a rigid elongated spline member forming a hinge with the inner edges of the front and back covers and having an inside surface contiguous with the inside surfaces of the front and back covers;

first leaf retaining means for retaining a portion of leaves on one side of an open multi-leaf article flat against the inside surface of the front cover;

second leaf retaining means for retaining the remaining leaves on another side of the open multi-leaf article flat against the inside surface of the back cover; and third leaf retaining means for retaining the fold of the multi-leaf article against the inside surface of the spline member.

2. Apparatus according to claim 1, wherein:

the first leaf retaining means includes a first bracket fitting around the bottom edge of the front cover, a second bracket fitting around the top edge of the front cover, and a band extending across the inside surface of the front cover from the first bracket to the second bracket; and the second leaf retaining means includes a third bracket fitting around the bottom edge of the back cover, a fourth bracket fitting around the top edge of the back cover, and a band extending across the inside surface of the back cover from the third bracket to the fourth bracket.

3. Apparatus according to claim 1, wherein:

the front cover includes a raised edge portion of thickness "u" along its outer edge, a raised edge portion having a sliding area of thickness "v" along its bottom edge, and a raised edge portion having a sliding area of thickness "v" along its top edge;

the back cover includes a raised edge portion of thickness "u" along its outer edge, a raised edge portion having a sliding area of thickness "v" along its bottom edge, and a raised edge portion having a sliding area of thickness "v" along its top edge;

the first leaf retaining means includes a first bracket positionable along the sliding area of the bottom edge of the front cover, a second bracket positionable along the sliding area of the top edge of the front cover, and a band extending across the inside surface of the front cover from the first bracket to the second bracket; and the second leaf retaining means includes a third bracket positionable along the sliding area of the bottom edge of the back cover, a fourth bracket positionable along the sliding area of the top edge of the back cover, and a band extending across the inside surface of the back cover from the third bracket to the fourth bracket.

4. Apparatus according to claim 1, wherein:

the inner edge of the front cover is provided with a series of square cutouts;

the inner edge of the back cover is provided with a series of square cutouts;

the spline member is provided with a first series of square cutouts mating with the square cutouts of the front cover and a second series of square cutouts mating with the square cutouts of the back cover;

a first hole is provided through the square cutouts of the front cover and the first series of square cutouts;

a first pin is provided through the first hole;

a second hole is provided through the square cutouts of the back cover and the second series of square cutouts; and a second pin is provided through the first hole;

5. Apparatus according to claim 1, wherein:

the third leaf-retaining means includes at least one band extending across the inside surface of the spline member.

6. Apparatus according to claim 5, wherein:

the third leaf-retaining means includes a plurality of bands.

7. Apparatus according to claim 1, further comprising:

a handle extending from the outer edge of one of the front or back covers.

8. Apparatus according to claim 1, further comprising:

a first hand-size handle extending from the outer edge of the front cover; and a second hand-size handle extending from the outer edge of the back cover.

9. Apparatus according to claim 1, further comprising:

means for retaining the holder/enclosure in a closed configuration when the front and back covers are closed about the hinge.

* * * * *